United States Patent [19]

Ohashi et al.

[11] Patent Number: 4,757,345

[45] Date of Patent: Jul. 12, 1988

[54] ELECTROPHOTOGRAPHIC SYSTEM

[75] Inventors: Kunio Ohashi, Nara; Kazuki Wakita, Yao; Tadashi Tonegawa, Nara; Syoichi Nagata, Yamatokouriyama; Masatsugu Nakamura, Nara; Kazuo Maeyama, Nara, all of Japan

[73] Assignee: Sharp Kabushiki Kaisha, Osaka, Japan

[21] Appl. No.: 819,426

[22] Filed: Jan. 16, 1986

[30] Foreign Application Priority Data

Jan. 7, 1985 [JP] Japan ..... 60-7029

[51] Int. Cl.[4] ..... G03G 15/00

[52] U.S. Cl. ..... 355/3 R; 355/3 CH; 430/902

[58] Field of Search ..... 355/3 CH, 3 R, 14 CH; 430/902, 31, 54; 361/225, 229; 250/234, 235, 236

[56] References Cited

U.S. PATENT DOCUMENTS 4,185,910 1/1980 Nomura et al. ..... 355/15

4,387,980 6/1983 Ueno et al. ..... 355/3 CH 4,408,865 11/1983 Camis et al. ..... 361/225 X 4,460,668 7/1984 Yoshida et al. ..... 355/3 CH X 4,607,936 8/1986 Miyakawa et al. ..... 355/3 R X

*Primary Examiner*—A. T. Grimley

*Assistant Examiner*—J. Pendegrass

*Attorney, Agent, or Firm*—Birch, Stewart, Kolasch & Birch

[57] ABSTRACT

An electric photographical copying system which provides a main charger for charging the photo-conductive layer of the recording medium, an optical exposure means for projecting an image of an original onto the photo-conductive layer to make an electrostatic latent image thereon, a developing device for developing the latent image with developer, a transfer device for transferring the image developed onto a copy sheet, a cleaning device for cleaning residual developer on the photo-conductive layer and an erasing device for erasing the surface potential of the photo-conductive layer. The devices are successively activated in an order to use the recording medium repeatedly.

11 Claims, 3 Drawing Sheets

ELECTROPHOTOGRAPHIC SYSTEM

BACKGROUND OF THE INVENTION

1. Field of the Invention

The present invention is related to the electrophotographic system for forming an image corresponding to the image of an original or the image of informations entered on a recording medium.

2. Description of the Prior Art

According to an electrostatic photo-copying machine, a laser printer or the like, optical information such as an image of an original or character data to be printed is projected onto a recording medium having a photoconductive layer, having been electrified or sensitized uniformly, to form an electrostatic latent image thereon. The latent image is developed with toner as a coloring agent and the image developed is transferred onto a copy paper. After the transfer of the image, toner still remaining on the recording medium is removed in order to use the recording medium repeatedly.

As a photo-conductive material for forming an electrostatic latent image on the photo-conductive layer of the recording medium, there is used an inorganic photoconductive material such as Se, CdS or ZnO, or an organic photo-conductive material such as PVK-TNF (polyvinyl carbozole-2,4,7-trinitro-9fluorenone).

None of these materials satisfy all of the conditions being required as a photoconductive material such as a high photo-sensitivity, a high spectroscopic photo-sensitivity, a high S/N ratio, a good durabilty and/or a pollution freedom for the human body. Under such a situation, one of them is relatively chosen according to the object of the application.

On the contrary to the above, amorphous silicon (hereinafter referred to a-Si) has been developed as a photo-conductive material since it is expected to have advantages such as a high photo-sensitivity, a high durability, a pollution freedom, etc.

However, it has disavantages as follows. One of them is that the band through which photo-carriers are moved has a skirt portion having a distribution of an exponential function at its end which gives undesirable effects upon forming the image.

FIG. 5 shows a conventional photo-copying system schematically.

Around a photo-conductive drum 1 having a photoconductive layer of a-Si, there are arranged a main charger 2 for electrifying the surface of the drum 1 into a predetermined polarity uniformly, an optical means 3 for focusing the reflected image of the original on the photoconductive layer to make an electrostatic latent image, a developing means 4 for developing the electrostatic latent image formed on the drum 1 with toner, a transfer means 5 for transferring the developed toner image onto a transfer sheet 6, a cleaning device 7 for removing residual toner on the drum and a photopotential eraser (discharger) 8 for erasing the surface potential remaining on the surface of the drum by applying light thereonto.

In the copying system mentioned above, photocarriers are captured in the skirt portion of the band mentioned above which have been generated excessively upon charging and exposuring by the main charger 2 and the optical means 3, respectively. These carriers will disappear by recombination therein directly or after being excited up to the band when they are left alone for a relatively long time. But, when the charging and exposure are repeated in a short time interval, carriers having been captured are urged to pass through the skirt portion of the band or the excited band by a strong potential generated upon charging and, then, cancel charges on the surface of the drum since each of them has a polarity opposite to that of the surface charge. Due to this, the surface potential of the drum is lowered to cause undesirable effects upon forming the image. This effect is enhanced with respect to a-Si, since both an electron and positive hole are movable therein.

Further, if the spectrum of the light used for exposure is different from that of the light used for erasing the surface potential, the distribution of carriers in the skirt portion will become different at the exposure and at the erasing of the surface potential. This causes memory effects since a level difference in the photo-fatigue is caused at the next main charging process. Therefore, the image is greatly affected due to memory affects to cause an irregular copy.

SUMMARY OF THE INVENTION

One essential object of the present invention is to provide an electrical photographical system in which the drop of the electrical potential can be kept small and the memory effect due to the photo-fatigue of a recording medium can be reduced effectively.

In order for that, according to the present invention, there is provided an electric photographical copying system which provides a main charger for charging the photo-conductive layer of the recording medium, an optical exposure means for projecting an image of an original onto the photo-conductive layer to make an electrostatic latent image thereon, a developing means for developing the latent image with developer, a transfer means for transferring the developed image onto a copy sheet, a cleaning means for cleaning residual developer on the photoconductive layer and an erasing means for erasing the surface potential of the photoconductive layer, and said means and/or devices are successively activated in the order of the citation to use the recording medium repeatedly, being characterized in that one pre-charger is provided for charging the photo-conductive layer with charge of the same polarity to that due to said main charger and prior to the charging thereby.

According to the present invention, the drop of the surface potential at the second time and thereafter can be kept small.

It is desirable that one more charger is provided for electrifying the photo-conductive layer prior to the erasing due to the eraser. The additional pre-charger can serve to reduce or to make disappear the memory effects which might be caused by repetition of the charging by the main charger and the exposure.

Therefore, according to the electric photographical system of the present invention, a faithful and fine image can be reproduced on the recording medium.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

This and other objects and features of the present invention will become more apparent from the description of the preferred embodiments accompanying the drawings attached herein; in which.

DESCRIPTION OF THE PREFERRED EMBODIMENTS

Figure 1:
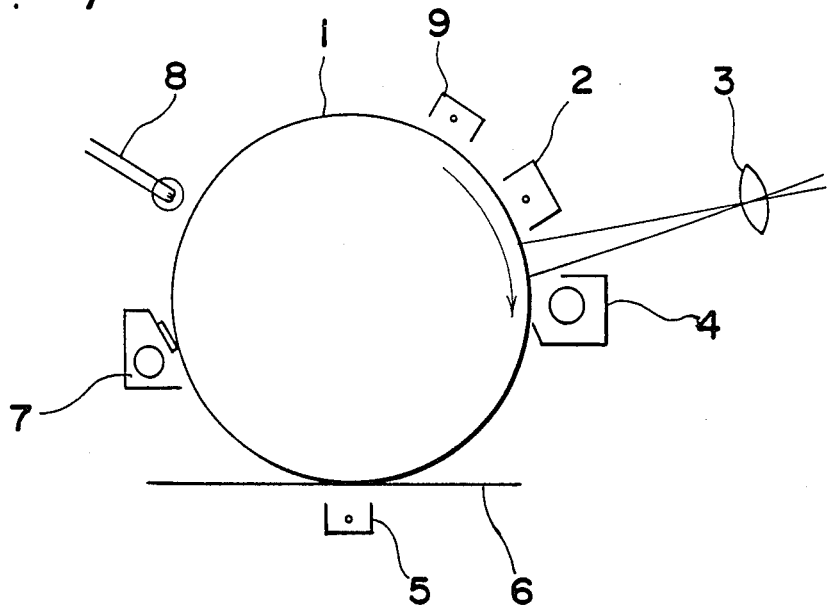
FIG. 1 is a schematical sectional view showing an arrangement of the preferred embodiment according to the present invention.

FIG. 1 shows a first preferred embodiment according to the present invention.

Figure 5:
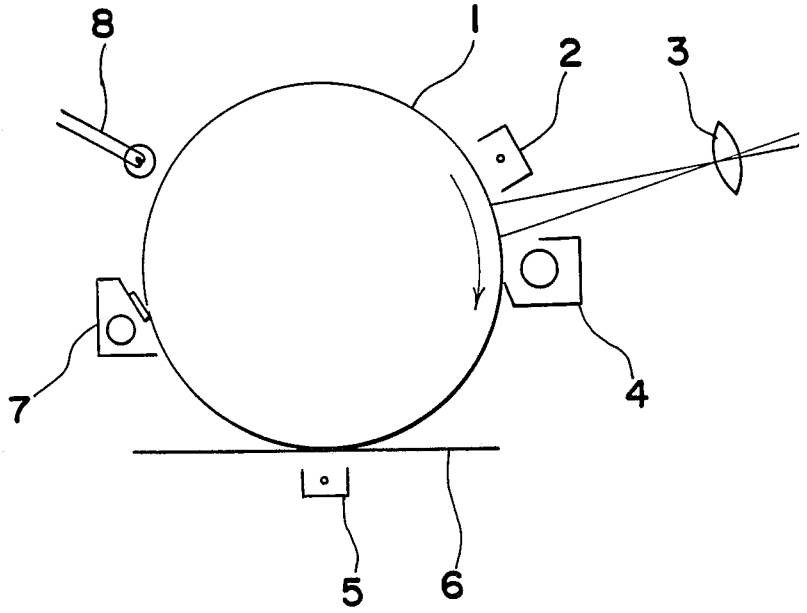
Fig. 5 PRIOR ART
FIG. 5 is a schematical sectional view showing an arrangement of the prior art.

In FIG. 1, reference numerals are used that correspond to the device or means shown in FIG. 5 mentioned above.

A drum 1 is driven to rotate about its center in a direction as indicated by an arrow. The drum 1 has a photo-conductive layer on its surface which is made of a photo-conductive material such as a-Si. The photo-conductive layer is electrified with a charge of a predetermined polarity uniformly by the main charger 2.

The light reflected from the original being illuminated by an exposure lamp means is projected in the focused state onto the photo-conductive layer through the optical means 3 to form an electrostatic latent image corresponding to the image of the original. The latent image on the photo-conductor 1 is developed by the developing device 4. The developed image, namely the toner image is transferred electro-statically onto a transfer material 6 being fed by a suitable transporting means (not shown) under the action of the electrifier or charger 5 for transferring.

Next, the residual toner remaining on the photoconductor 1 is removed by the cleaning device 7 and the residual surface potential is erased uniformly by the photo-potential eraser or photo-discharger 8 in order to make the next image formation possible.

As indicated by the reference numeral 9 in FIG. 1, there is provided and arranged a pre-charger 9 before the main charger 2 when seen in the direction of the rotation of the drum 1. Namely, the photo-conductor 1 is preelectrified prior to the charging by the main charger 2. The polarity due to the pre-charger 9 is determined to be the same to that due to the main charger 2.

The inventors of the present invention tested changes of the electrifying potential or surface potential of the photo-conductor 1 having a-Si layer as a photoconductive layer which might be obtained when the charging and exposure were repeated.

The charging rate of the main charger used in this test is 0.3 $\mu C/cm^2$ and the polarity thereof is positive. A halogen lamp of 1001 ux is used as an exposure lamp.

Figure 2:
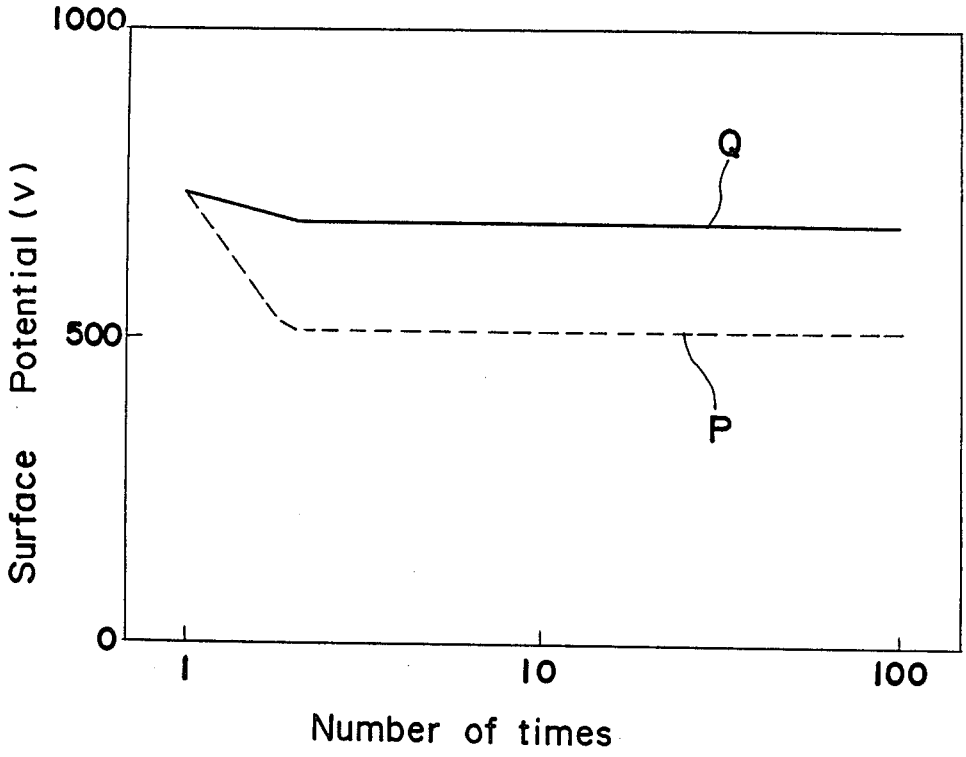
FIG. 2 is a graph showing characteristics of the surface potential of a recording medium being obtained respectively according to the present invention and the prior art.

When the charging and exposure by the main charger 2 and the exposure lamp were repeated without the precharging, the surface potential of the photo conductor 1 was changed as indicated by a dotted line P in FIG. 2. In this conventional process, whereas the initial surface potential was of 730[V], the surface potential was reduced to 510[V] at the second time and thereafter.

Contrary to the above, when the pre-charging, the charging by the main charger and the exposure were repeated, the surface potential was reduced only to 690[V] at the second time and thereafter as indicated by a solid line Q in FIG. 2. In other words, according to the present invention, the drop of the surface potential is kept very small and, therefore, the surface potential is kept stable. In this test, the pre-charger used was same as the main charger mentioned above.

Next, an evaluation test based on the surface potential and the image formed was done according to the process with use of the copying machine as shown in FIG. 1.

The charging rate of the main charger 2 was of 0.3 $\mu C/cm^2$ and the polarity thereof was positive. A halogen lamp was used as the exposure lamp and a fluorescent lamp was used as the lamp for the photo-potential eraser 8.

The results obtained are shown in the next table below.

| | Case | | | |
|---|---|---|---|---|
| | A | B | C | D |
| Surface Potential | 510 V | 650 V | 520 V | 650 V |
| Evaluation of Image | no good | good | excellent | excellent |

Case A shows the results obtained when charging by the main charger 2, the exposure by the halogen lamp and the photo-potential erasing by the photo-potential eraser 8 were done, repeatedly.

As is clearly understood from the results of case A, the surface potential of the photo-conductor 1 is lowered to 510[V] and the memory effects are observed in the image which give bad effects to the image to be formed.

Contrary to the above, when pre-charging with precharger 9 was done prior to the main charging the surface potential was raised up to 650[V] and the memory effects almost disappeared as shown in case B in the table.

As is clear from above, when the pre-charging is done prior to the main charging with the main charger according to the process of the present invention, the drop of the surface potential is kept very small, and the memory effects disappear.

Figure 3:
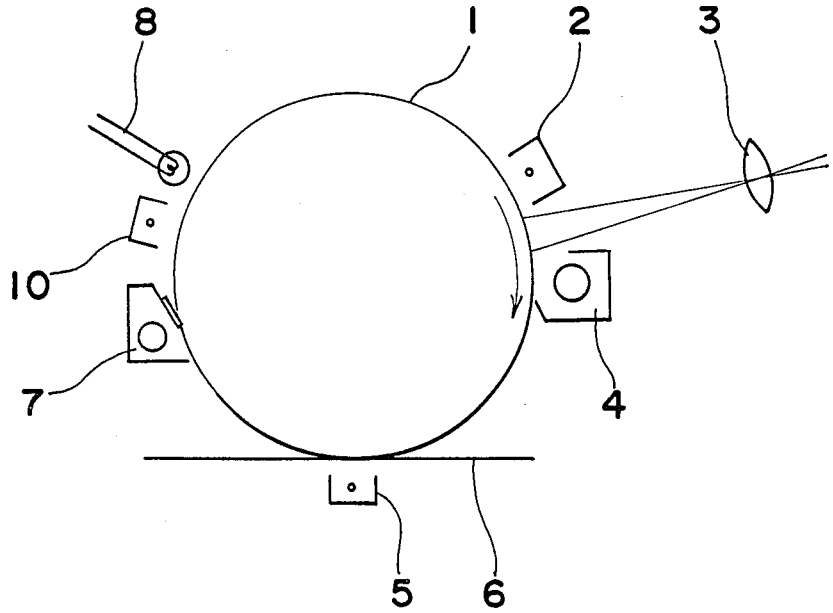
FIGS. 3 and 4 are schematical sectional views respectively showing an arrangement of another preferred embodiment according to the present invention.

In the second preferred embodiment, the precharger 10 is arranged between the cleaning device 7 and the photo-potential eraser 8 as is shown in FIG. 3. The precharger 10 used is the same one as the main charger. In the case with pre-charging the pre-charger 10 done prior to the photo-potential erasing, the memory effects were not observed at all, although the surface potential was reduced to 520[V], as is shown in case C in the table.

Figure 4:
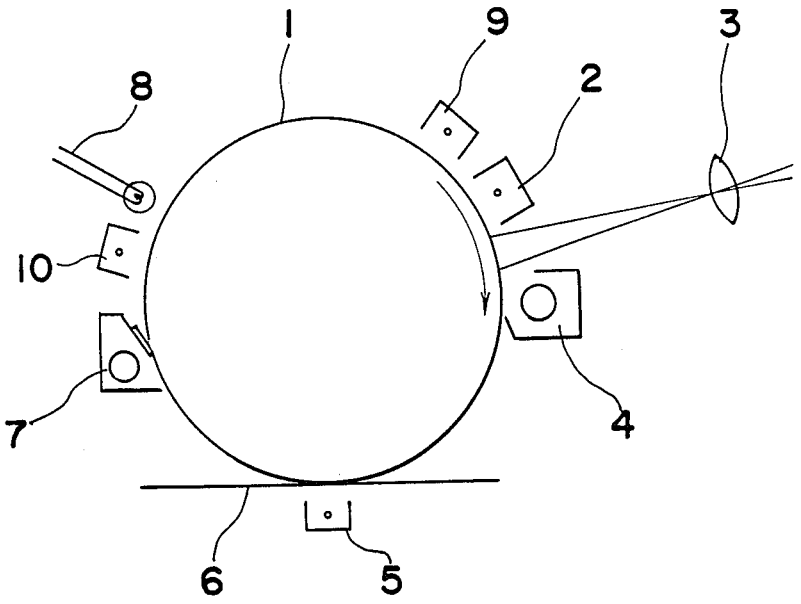

In the third embodiment as shown in FIG. 4, two pre-chargers 9 and 10 are arranged before the main charger 2 and the photo-potential eraser 8 respectively. In this embodiment, a high surface potential of 650[V] was obtained and the memory effects were not observed at all as shown in case D in the table.

These results mentioned above suggest that the memory effect can be made to disappear when the precharging was done prior to the photo-potential erasing due to the photopotential eraser 8 as shown in FIGS. 3 and 4. Also, it is suggested that the drop of the surface potential can be kept small when pre-charging is done prior to charging by the main charger 2 as shown in FIGS. 1 and 4.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. An electrophotographic copying system comprising:

a drum rotatably mounted and having a photo-conductive layer thereon, said photo-conductive layer is made of amorphous silicon;

optical exposure means for projecting an image of an original onto said photo-conductive layer to form an electrostatic latent image thereon;

developing means for developing the latent image with a developer;

transfer means for transferring the developed image onto a copy sheet;

cleaning means for cleaning residual developer from said photo-conductive layer;

erasing means for erasing surface potential on said photo-conductive layer, said erasing means is positioned remote from a location of said pre-charging means and said pre-charger is located near said main charger;

main charging means for charging said photo-conductive layer; and pre-charging means for charging said photo-conductive layer, said cleaning means, said erasing means, said pre-charging means, and said main charging means act in sequence on said photo-conductive surface in the order of cleaning means and erasing means, pre-charging means, main charging means prior to exposure of said photo-conductive surface.

2. The system according to claim 1, wherein said erasing means is a light emitting device.

3. The system according to claim 2, wherein said pre-charging means and said main charging means charge said photo-conductive surface with charge of the same polarity.

4. The system according to claim 1, wherein said erasing means is a light emitting device.

5. The system according to claim 1, wherein said pre-charging means and said main charging means charge said photo-conductive surface with charge of the same polarity.

6. The system according to claim 1, wherein said pre-charging means and said main charging means charge said photo-conductive surface with charge of the same polarity.

7. An electrophotographic copying system comprising:

a drum rotatably mounted and having a photo-conductive layer thereon, said photo-conductive layer is made of amorphous silicon;

optical exposure means for projecting an image of an original onto said photo-conductive layer to form an electrostatic latent image thereon;

developing means for developing the latent image with a developer;

transfer means for transferring the developed image onto a copy sheet;

cleaning means for cleaning residual developer from said photo-conductive layer;

erasing means for erasing surface potential on said photo-conductive layer;

main charging means for charging said photoconductive layer;

first pre-charging means for charging said photoconductive layer; and second pre-charging means for charging said photoconductive layer;

said first pre-charging means, said second pre-charging means, said erasing means, and said main charging means act in sequence on said photoconductive surface in the order of first pre-charging means, erasing means, second pre-charging means, main charging means prior to exposure of said photoconductive surface.

8. The system according to claim 7, wherein said first pre-charging means is located remote from a location of said second pre-charging means and said second pre-charging means is located near said main charging means.

9. The system according to claims 8, wherein said cleaning means acts on said photoconductive surface prior to said first pre-charging means.

10. The system according to claim 7, wherein said erasing means is a light emitting device.

11. The system according to claim 7, wherein said pre-charging means and main charging means charge said photo-conductive surface with charge of the same polarity.

* * * * *